US007744549B2

(12) United States Patent
Wu et al.

(10) Patent No.: US 7,744,549 B2
(45) Date of Patent: Jun. 29, 2010

(54) MASSAGE DEVICE

(75) Inventors: Chichun Wu, Shaling Industrial Park, Xiahou, Dongcheng, Dongguan City, Guangdong Province (CN); Chi-Wu Chiang, Dongguan (CN)

(73) Assignee: Chichun Wu, Dongguan (CN)

( * ) Notice: Subject to any disclaimer, the term of this patent is extended or adjusted under 35 U.S.C. 154(b) by 832 days.

(21) Appl. No.: 11/625,267

(22) Filed: Jan. 19, 2007

(65) Prior Publication Data

US 2007/0118059 A1 May 24, 2007

Related U.S. Application Data

(63) Continuation-in-part of application No. 11/082,016, filed on Mar. 16, 2005, now abandoned.

(30) Foreign Application Priority Data

May 11, 2004 (CN) ..... 2004 2 00456092

(51) Int. Cl.
*A61H 15/00* (2006.01)
*A61H 7/00* (2006.01)

(52) U.S. Cl. ..... 601/97; 601/101; 601/103

(58) Field of Classification Search ..... 601/84, 601/86, 87, 90, 91, 93, 94, 97, 98, 100, 101, 601/103, 112, 113, 115, 116, 126, 127, 134, 601/136

See application file for complete search history.

(56) References Cited

U.S. PATENT DOCUMENTS

| | | | | |
|---|---|---|---|---|
| 6,196,983 | B1 * | 3/2001 | Wu | 601/99 |
| 7,052,477 | B2 * | 5/2006 | Wu et al. | 601/99 |
| 2005/0245851 | A1 * | 11/2005 | Ferber et al. | 601/86 |
| 2006/0211962 | A1 * | 9/2006 | Ferber et al. | 601/86 |

* cited by examiner

*Primary Examiner*—Quang D Thanh
(74) *Attorney, Agent, or Firm*—Morris, Manning & Martin LLP; Tim Tingkang Xia

(57) ABSTRACT

A massage device includes a base cover having a fix bore defined in its backside; a guiding device disposed in the base cover; and a moving base received in the base cover and movably mounted on the guiding device. The moving base has a securing hole defined therein. The massage device further includes a bolt with a locking portion, and the locking portion is inserted in both the fix bore and the securing hole.

7 Claims, 6 Drawing Sheets

MASSAGE DEVICE

CROSS-REFERENCE TO RELATED APPLICATION

This is a continuation in part patent application of the U.S. patent application Ser. No. 11/082,016, filed on Mar. 16, 2005, now abandoned, which itself claims the foreign priority of the Chinese patent application No. 2004200456092, filed on May 11, 2004, the contents of which are incorporated herein in their entireties by reference.

FIELD OF THE INVENTION

The present invention relates to a massage device, and more particularly, relates to a massage device having protection structure to protect its moving parts from being damaged during transportation.

BACKGROUND OF THE INVENTION

Massage devices are commonly used equipments for relaxing muscles of users. These massage devices contain complex transmission elements therein for realizing comfortable muscle-relaxing effects. Generally, a set of gears and a pair of rack-type rails are employed to move certain kneading structure of a massage device back and forth.

The set of gears can be driven by a motor mounted in the massage device so as to move the kneading structure along the pair of rails. When no power is input to the motor, the gears are free from drive of the motor and thus can move relative to the rails when sudden external forces are applied to the massage device.

Undesirable movement of the gears due to sudden external forces most often occurs during transportation of the massage device e.g. from a manufacture place to a sale place, as during transportation, variable forces are applied to the massage device and thus make the gears move back and forth with respect to the rails. Frequent and sudden movement of the gears with respect to the rails results in worn-out and even broken damage of the gears/rails. Consequently, the gears/rails will be out of use and the entire massage device will lose its function.

Hence, it is desired to provide a massage device to solve the above-mentioned problems.

SUMMARY OF THE INVENTION

To overcome the above drawbacks of prior art, a main object of the present invention is to provide a massage device which can protect the gears and rack from being damaged by sudden external forces during transportation of the device.

A massage device is provided, which includes a base cover having a fix bore defined in its backside; a guiding device disposed in the base cover; and a moving base received in the base cover and movably mounted on the guiding device. The moving base has a securing hole defined therein. The massage device further includes a bolt with a locking portion, and the locking portion is inserted in both the fix bore and the securing hole.

The shield block further comprises a grip ring connected to the locking portion. The massage device further comprises a power wire with a plug provided at its one end. A receiving hole is defined in the locking portion of the shield block, and the plug is contained in the receiving hole.

The massage device further comprises a limiting ring mounted on the backside of the base cover and a shield block pivotally mounted on the backside of the base cover. A through hole is defined in the limiting hole and aligned with the fix bore of the base cover. The shield block is able to rotate into a gap defined between the limiting ring and the backside of the base cover such that the fix bore can be covered by the shield block after the bolt is taken out from the fix bore.

The limiting ring includes an annular portion and a plurality of protrusions extended downwardly from the annular portion, and the through hole is defined in the annular portion. A plurality of mounting holes is defined in the backside of the base cover at locations around the fix bore. The protrusions are secured in respective mounting holes.

A pivoting shaft is formed on the backside of the base cover. The shield block includes a main body with a pivoting hole defined therein. The pivoting shaft is received in the pivoting hole such that the shield block is rotatable around the pivoting shaft.

A spring-receiving hole is defined in the main body of the shield block. A stop post is formed on the backside of the base cover. A spring having a first end and a second end is disposed between the shield and the pivoting shaft, the first end being inserted in the spring-receiving hole and the second end being pressed against the stop post. The shield block is mounted on the backside of the base cover by a screw.

For the purpose of making the invention easier to understand, several particular embodiments thereof will now be described with reference to the appended drawings in which:

DETAILED DESCRIPTION OF THE INVENTION

Figure 1:
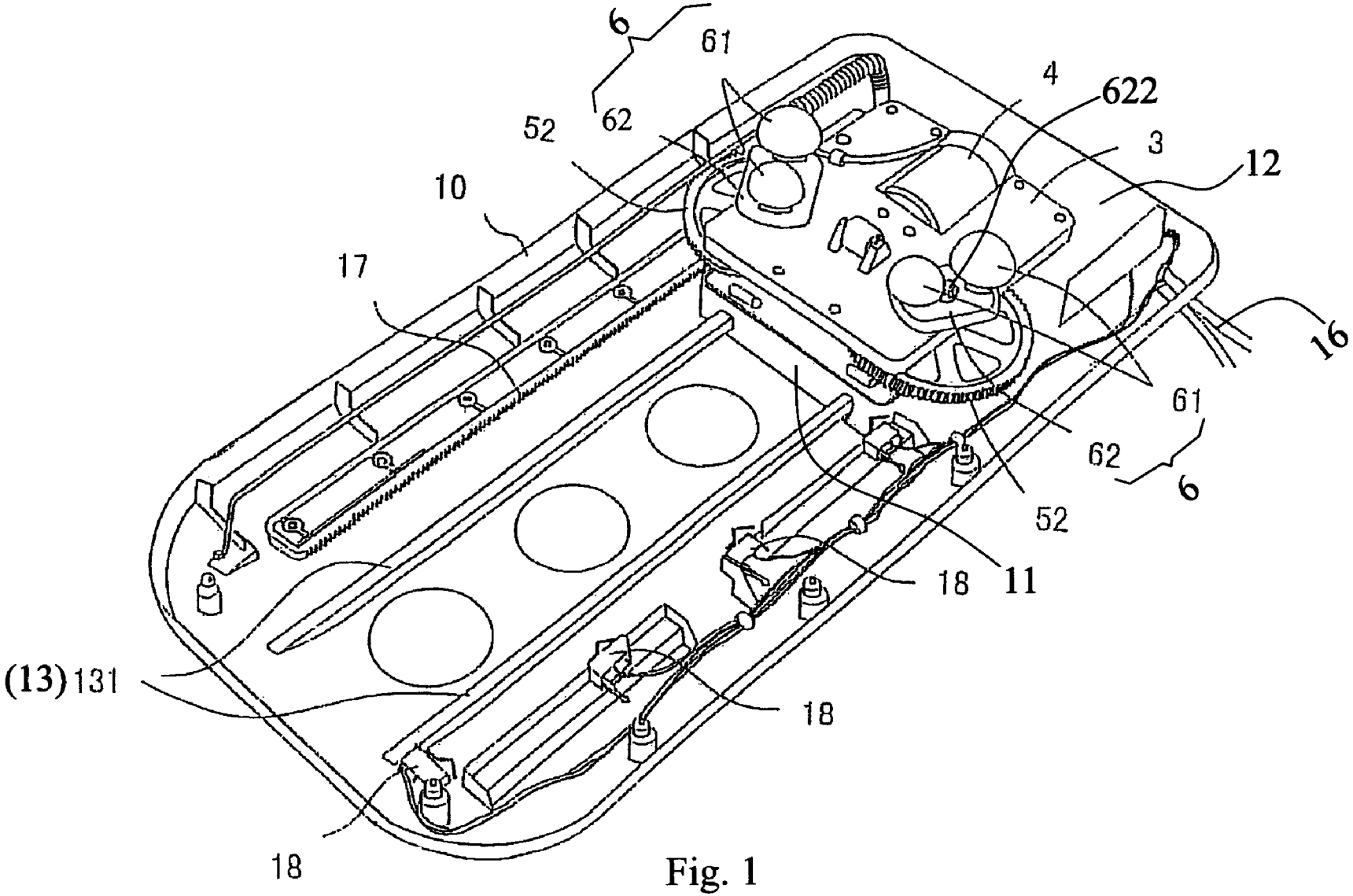
FIG. 1 is a perspective view of a massage device with a single drive motor according to an embodiment of the invention.
Figure 2:
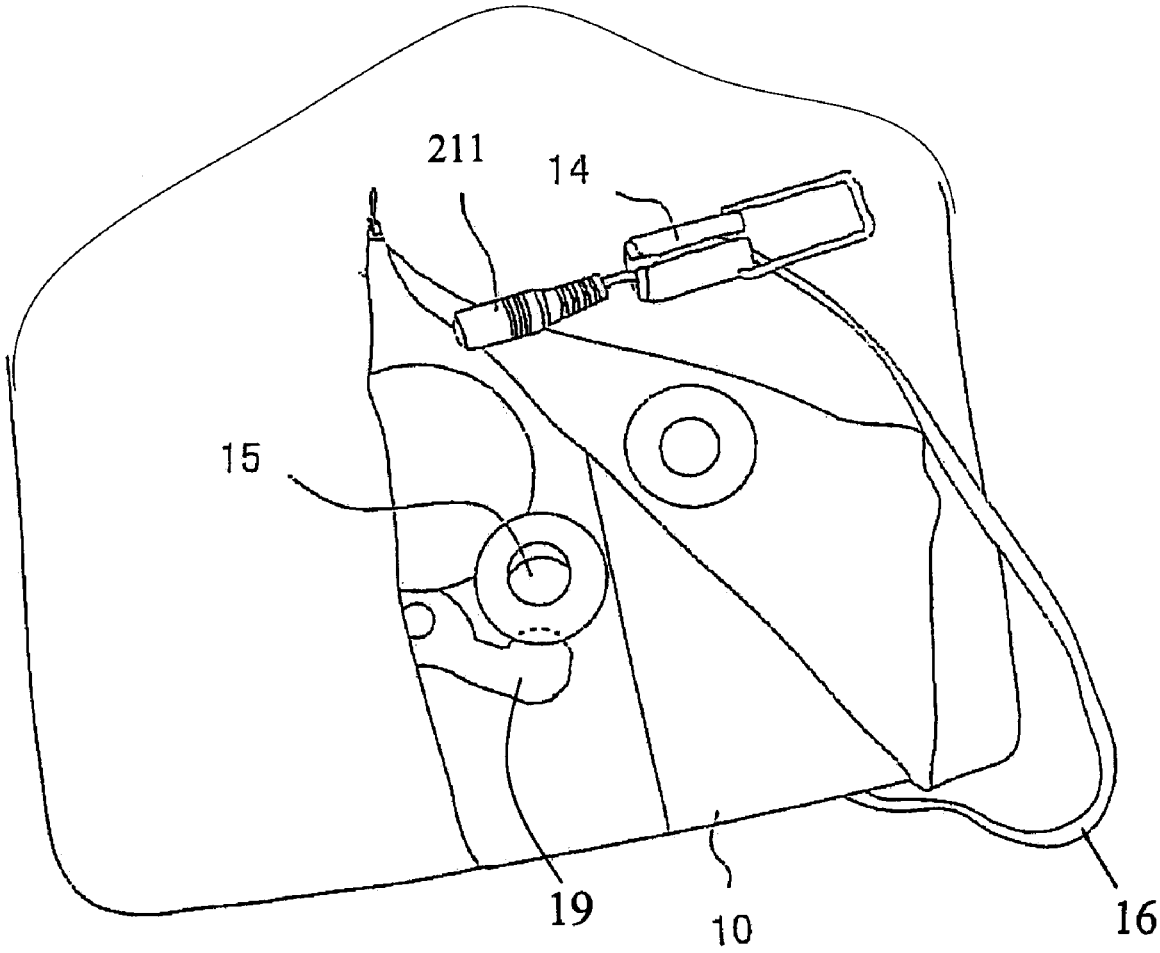
FIG. 2 is a backside view of the massage device of FIG. 1 to show protection structure of the device.
Figure 3A:
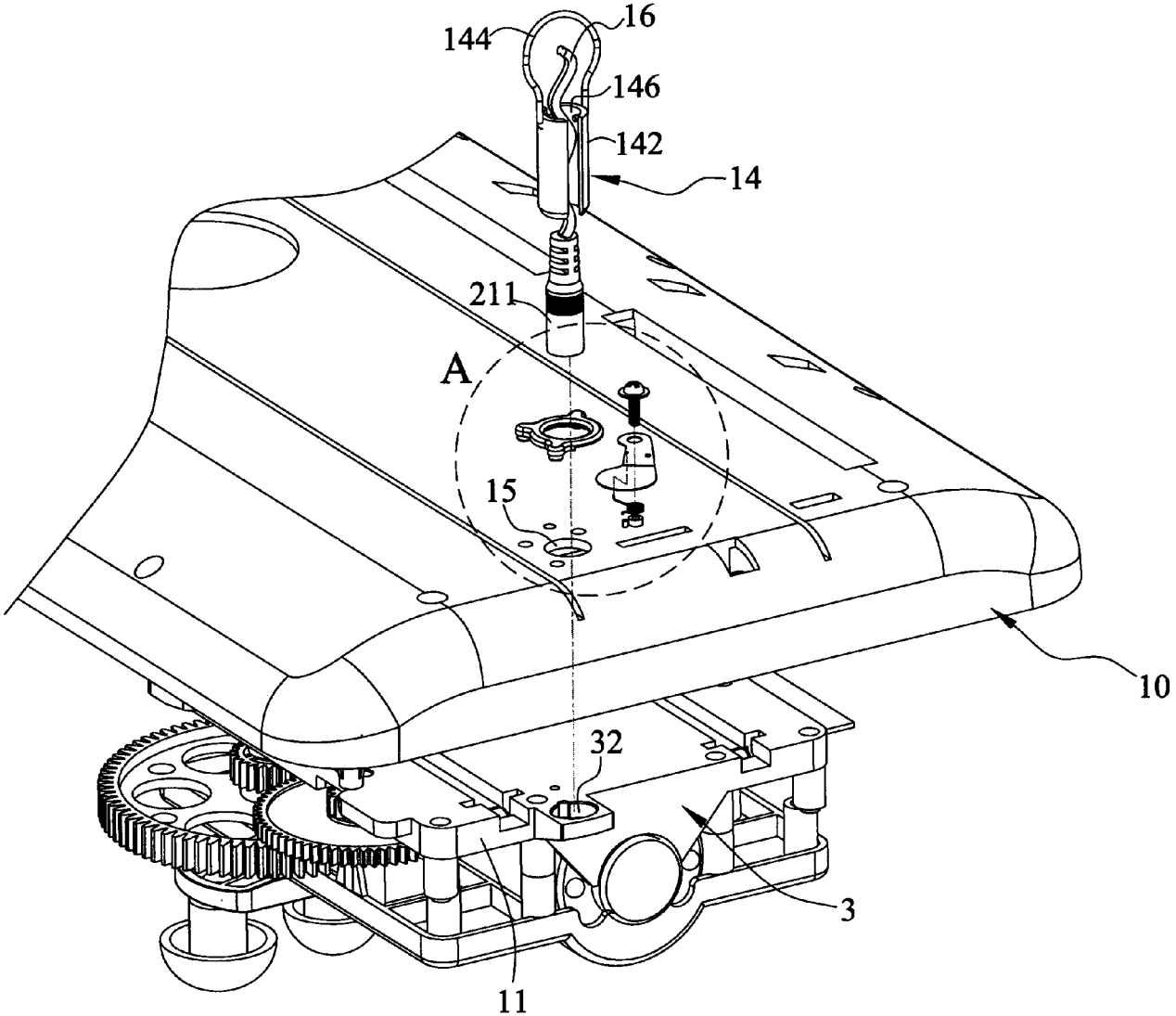
FIG. 3*a* is a partially exploded view of the massage device of FIG. 2 to show detailed elements of the protection structure in an exploded state.
Figure 3B:
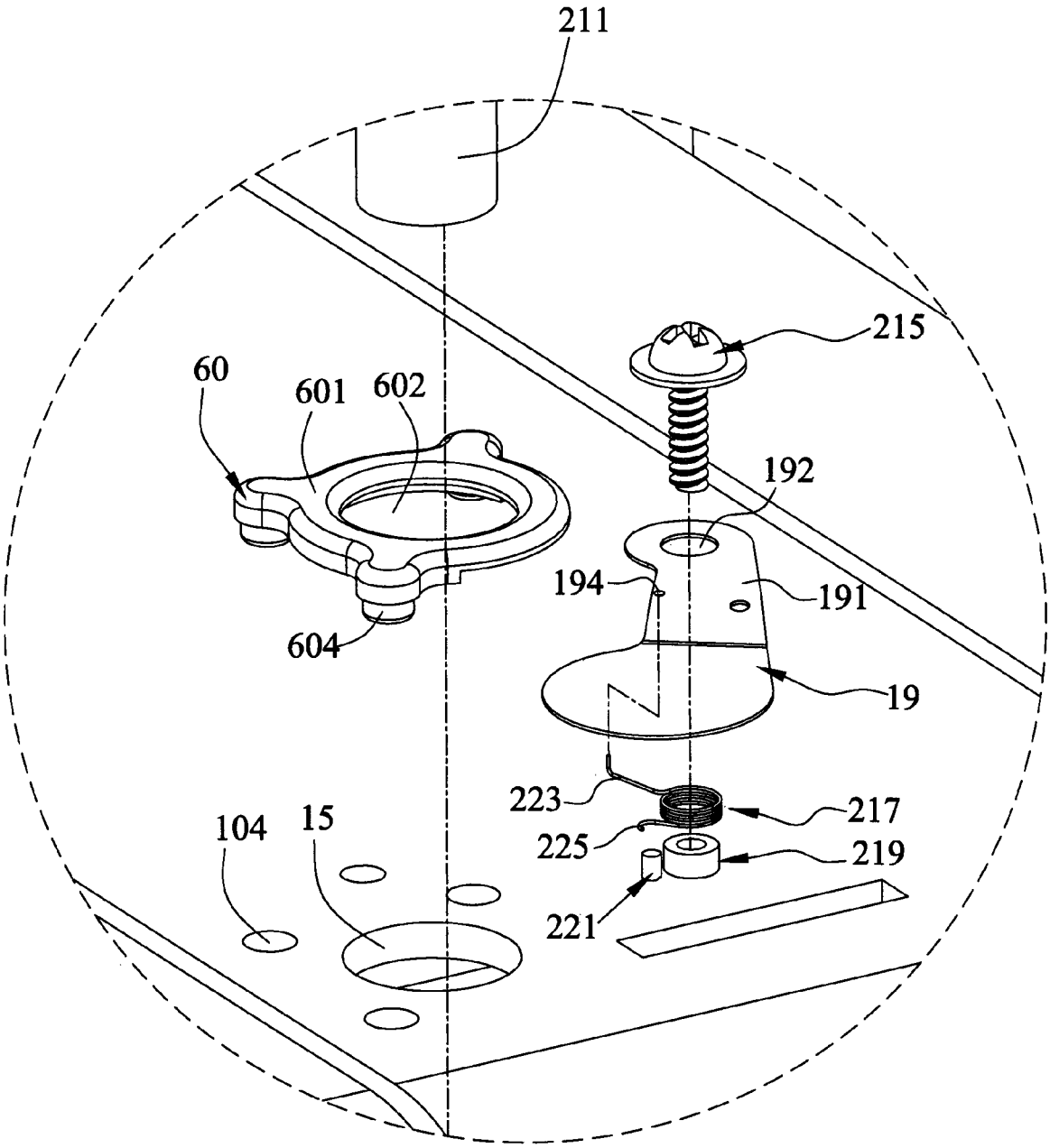
FIG. 3*b* is an enlarged view of portion A of the massage device of FIG. 3*a;*
Figure 4A:
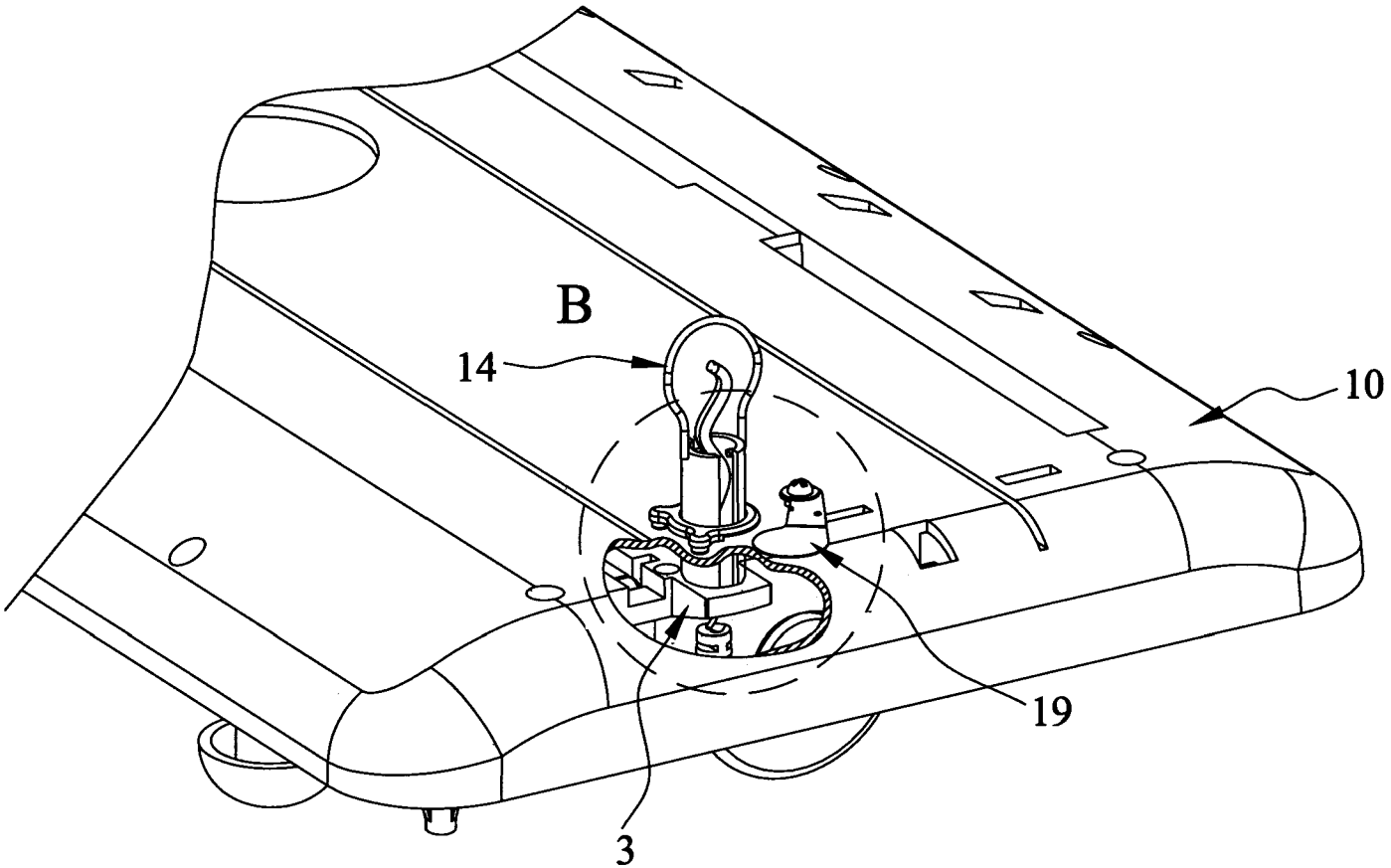
FIG. 4*a* is a partial perspective view of the massage device of FIG. 3*a* to show detailed elements of the protection structure in an assembled state.
Figure 4B:
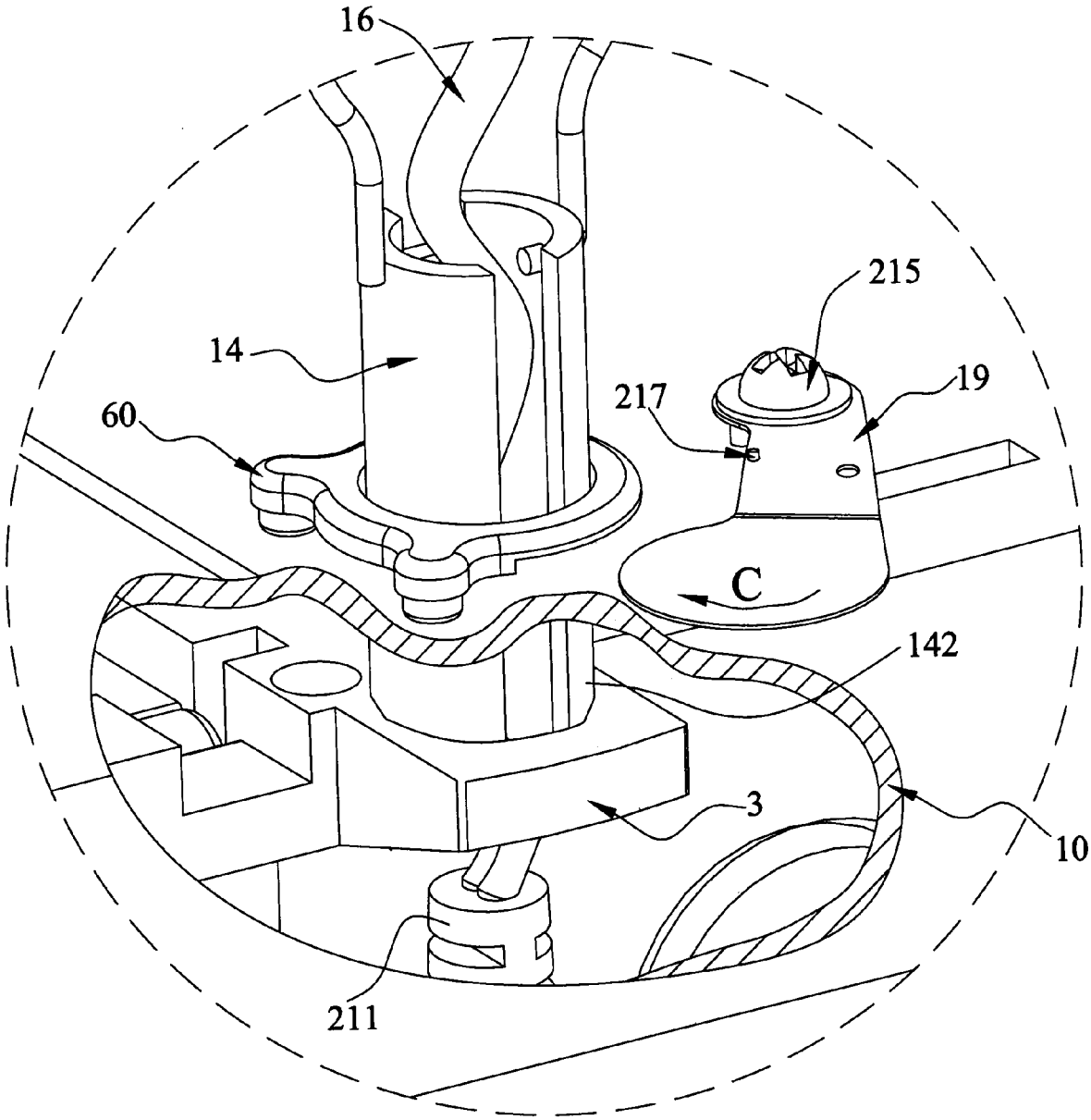
FIG. 4*b* is an enlarged view of portion B of the massage device of FIG. 4*a*.

As shown in FIGS. 1-4*b*, according to an embodiment of the invention, a massage device comprises a base cover 10, a guide device 13 disposed in the base cover 10 and a moving base 3 received in the base cover 10 and movably positioned on the guide device 13.

The moving base 3 comprises a bottom 11 and a shield 12 covered on the bottom 11 so as to form a chassis. The moving base 3 further comprises a motor 4 mounted between the bottom 11 and the shield 12; a plurality of gears 52 connected to and driven by the motor 4; and a pair of massage systems 6 disposed on the shield 12 and driven by the plurality of gears 52 respectively. Each massage system 6 comprises a rotation shelf 62 with a pair of kneading heads 61 mounted thereon. Each rotation shelf 62 can rotate about a shaft 622 which passes through respective gear 52 and can rotate together with the gear 52. The guide device 13 is constituted by a plurality of guide rails 131 positioned in a middle region of the base cover 10.

When power is input to the motor 4 via a power wire 16 and a plug 211 formed at one end of the power wire 16, the motor 4 will work and then drive the gears 52 to rotate around their own shafts 622 (only one shaft is shown). The rotation will further lead to rotary movement of the rotation shelves 62 along with the kneading heads 61 mounted thereon, thus achieving muscle-relaxing effect to a user.

In addition, a rack 17 is placed in the base cover 10, and the moving base 3 further comprises a corresponding driving gear (not shown) for engaging with the rack 17. When the motor 4 works, the driving gear is rotated and then moves with respect to the rack 17 such that the entire moving base 3 travels along the guide rails 131.

In the embodiment, several route switches 18 are set along the moving route of the moving base 3 in the base cover 10. The route switches 18 can make the moving base 3 stay at different positions for massaging different body portion conveniently.

As explained in background section of the application, during transportation of the massage device, the gears and rack of the device may be damaged by their interaction due to sudden external forces. For preventing these damages, a special protection structure is provided on the massage device of the invention. More particularly, referring to FIGS. 2-4*b*, an additional bolt 14 is presented which can be inserted into a fix bore 15 defined in the backside of the base cover 10 and a securing hole 32 defined in one end of the bottom 11 of the moving base 3.

The bolt 14 comprises a locking portion 142 and a grip ring 144 connected to the locking portion 142. The locking portion 142 has a receiving hole 146 defined therein. The locking portion 142 can be temporarily inserted into both the fix bore 15 and the securing hole 32 so that the moving base 3 is kept stationary with respect to the base cover 10 (the guide rails 131) during transportation of the massage device. When a user wants to use the massage device, he can hook the grip ring 144 and then draw the entire bolt 14 out of the fix bore 15 and the securing hole 32, thus releasing the moving base 3 from a locked status to a free status. As the moving base 3 is in a free status, it can move when driven by the motor 4 (as shown in FIG. 1).

Compared with conventional technology, as a stop element (the bolt 14) is provided to stop movement of the moving base 3 with respect to the guide rails 131, the gears and rack inside the massage device can be protected from being damaged during transportation.

The present invention further provides anther feature which prevents the user from connecting the plug 211 to a power source before the bolt 14 is taken out of the fix bore 15 and the securing hole 32, thereby protecting the gears and rack from being damaged. Namely, as shown in FIGS. 2-4*b*, the plug 211 is held in the receiving hole 146 of the bolt 14. When the bolt 14 is inserted into the fix bore 15 and the securing hole 32, the plug 211 is also contained therein, and as a result, the plug 211 can not be taken out until the bolt 14 is taken out. Therefore, the user is able to connect the plug 211 to a power source only after the plug 211 and the bolt 14 are pulled out together, thus preventing the gears, rack and/or motor being damaged due to stop of the bolt 14. After they are taken out, the plug 211 can be taken out from the bolt 14.

After the bolt 14 is removed from the fix bore 15, the fix bore 15 is exposed directly to the air, and in this situation, external dust can easily fall into the moving base 3 via the fix bore 15. For protecting the moving base 3, the present invention further provides anther feature. Referring to FIGS. 2-4*b*, a limiting ring 60 and a shield block 19 are mounted on the backside of the base cover 10 to provide protection.

The limiting ring 60 includes an annular portion 601 with a through hole 602 defined therein and a plurality of protrusions 604 extended downwardly from the annular portion 601. The limiting ring 60 is mounted on the backside of the base cover 10 with its protrusions 604 secured in respective mounting holes 104 defined around the fix bore 15. In addition, the through hole 602 is aligned with the fix bore 15 so that the bolt 14 can be inserted therethrough. Since the protrusions 604 are extended from the annular portion 601, a gap (not labeled) is formed between the annular portion 601 and the backside of the base cover 10.

The shield block 19 comprises a main body 191. A pivoting hole 192 and a spring-receiving hole 194 are defined in the main body 191. The shield block 19 is pivotally mounted on backside of the base cover 10. Namely, a pivoting shaft 219 is formed on the backside of the base cover 10 and received in the pivoting hole 192 such that the shield block 19 can rotate around the pivoting shaft 219. A spring 219 having a first and second ends 223, 225 is mounted on the pivoting shaft 219. The first end 223 is inserted in the spring hole 194, and the second end 225 is pressed against a stop post 221 formed on the backside of the base cover 10 at a position adjacent the pivoting shaft 219. In addition, a screw 215 is used to mount the shield block 19 to the pivoting shaft 219. After all the above components are assembled together, the spring 217 is disposed between the shield block 19 and the pivoting shaft 219.

In case when the bolt 14 is still inserted in the fix bore 15 and the securing hole 32 of the moving base 3, the edge of the main body 191 of the shield block 19 will always be pressed against the locking portion 142 of the bolt 14 by the spring 217. Once the bolt 14 is taken out, the main body 191 will radially move to the fix bore 15 (as illustrated by arrow C in FIG. 4*b*) and then be stopped by the protrusions 604 such that the fix bore 15 is covered by the main body 191. By movement of the shield block 19, the fix bore 15 is immediately covered such that external dust can not fall into the base cover 10.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A massage device, comprising:

a base cover having a fix bore defined in its backside;

a guiding device disposed in the base cover;

a moving base received in the base cover and movably mounted on the guiding device, the moving base having a securing hole defined therein;

a bolt with a locking portion, the locking portion being inserted in both the fix bore and the securing hole; and a power wire with a plug provided at its one end, a receiving hole being defined in the locking portion of the bolt, and the plug being contained in the receiving hole.

2. The massage device as claimed in claim 1, wherein the bolt comprises a grip ring connected to the locking portion.

3. A massage device comprising:

a base cover having a fix bore defined in its backside;

a guiding device disposed in the base cover; and a moving base received in the base cover and movably mounted on the guiding device, the moving base having a securing hole defined therein;

a bolt with a locking portion, the locking portion being inserted in both the fix bore and the securing hole; and a limiting ring mounted on the backside of the base cover, a through hole being defined in the limiting ring and aligned with the fix bore of the base cover; and a shield block pivotally mounted on the backside of the base cover, the shield block being able to rotate into a gap defined between the limiting ring and the backside of the base cover, such that the fix bore can be covered by the shield block after the bolt is taken out from the fix bore.

4. The massage device as claimed in claim 3, wherein the limiting ring includes an annular portion and a plurality of protrusions extended downwardly from the annular portion, and the through hole is defined in the annular portion; wherein a plurality of mounting holes is defined in the backside of the base cover at locations around the fix bore; wherein the protrusions are secured in respective mounting holes.

5. The massage device as claimed in claim 3, wherein a pivoting shaft is formed on the backside of the base cover; wherein the shield block includes a main body with a pivoting hole defined therein; wherein the pivoting shaft is received in the pivoting hole such that the shield block is rotatable around the pivoting shaft.

6. The massage device as claimed in claim 5, wherein a spring-receiving hole is defined in the main body of the shield block; wherein a stop post is formed on the backside of the base cover; wherein a spring having a first end and a second end is disposed between the shield block and the pivoting shaft, the first end being inserted in the spring-receiving hole and the second end being pressed against the stop post.

7. The massage device as claimed in claim 3, wherein the shield block is mounted on the backside of the base cover by a screw.

* * * * *